US005335729A

United States Patent [19]

Turner et al.

[11] Patent Number: 5,335,729

[45] Date of Patent: Aug. 9, 1994

[54] TUBULAR CONNECTION, METHOD FOR MAKING SAME, AND TOOL THEREFOR

[75] Inventors: Edwin C. Turner; Charles E. Gibbs, both of Houston, Tex.

[73] Assignee: Cooper Industries, Inc., Houston, Tex.

[21] Appl. No.: 880,828

[22] Filed: May 11, 1992

[51] Int. Cl.[5] ..... E21B 33/04

[52] U.S. Cl. ..... 166/380; 166/382; 166/384; 285/382

[58] Field of Search ..... 166/298, 297, 380, 382, 166/384, 55, 207; 285/382, 382.4, 382.5; 29/507, 522.1, 523

[56] References Cited

U.S. PATENT DOCUMENTS

| | | | |
|---|---|---|---|
| 2,134,311 | 10/1938 | Minor et al. | 166/14 |
| 2,189,703 | 2/1940 | Burt et al. | 166/12 |
| 2,274,093 | 2/1942 | Ragland et al. | 166/2 |
| 2,460,580 | 2/1949 | Huber | 153/79 |
| 2,467,801 | 4/1949 | Baker | 166/12 |
| 2,467,822 | 4/1949 | Griffin et al. | 166/12 |
| 2,681,112 | 6/1954 | Lee | 166/115 |
| 3,885,298 | 5/1975 | Pogonowski | 29/507 |
| 4,580,426 | 4/1986 | Zafred | 72/58 |
| 4,791,796 | 12/1988 | Ford | 72/56 |
| 4,830,109 | 5/1989 | Wedel | 166/277 |
| 4,869,319 | 9/1989 | Szymzak et al. | 166/115 |
| 4,902,048 | 2/1990 | Washizu | 285/319 |
| 4,902,049 | 2/1990 | Umehara | 285/347 |
| 4,979,285 | 12/1990 | Martin | 29/522.1 X |
| 5,010,952 | 4/1991 | Chin et al. | 166/75.1 |

OTHER PUBLICATIONS

Society of Petroleum Engineers Papers Nos. SPE 23054, 23057 and 23058 Presented at Offshore Europe Held in Aberdeen, Scotland, Sep. 3–6, 1991.

*Primary Examiner*—William P. Neuder

*Attorney, Agent, or Firm*—Eddie E. Scott; Jack R. Springgate

[57] ABSTRACT

A tubular connection between an inner and an outer tubular member with the outer member having internal recesses and the inner member being mechanically forged into said recesses, the recesses and the forging being such that the outer member is not subject to a strain greater than its elastic limit and such outer member may be a relatively thin member as compared to the prior art structures. The members may be joined while in tension and the tension is preserved in the completed connection. The tool for making the connection includes a plurality of forging segments coacting with a multiple lobe cone, a pressure responsive means for creating relative movement between the forging segments and the cone and means for running the structure into a subsea casing and for supporting the other elements of the tool including the two tubular members during the forging step and being recoverable from within the forged connection.

6 Claims, 9 Drawing Sheets

FIG. 2A
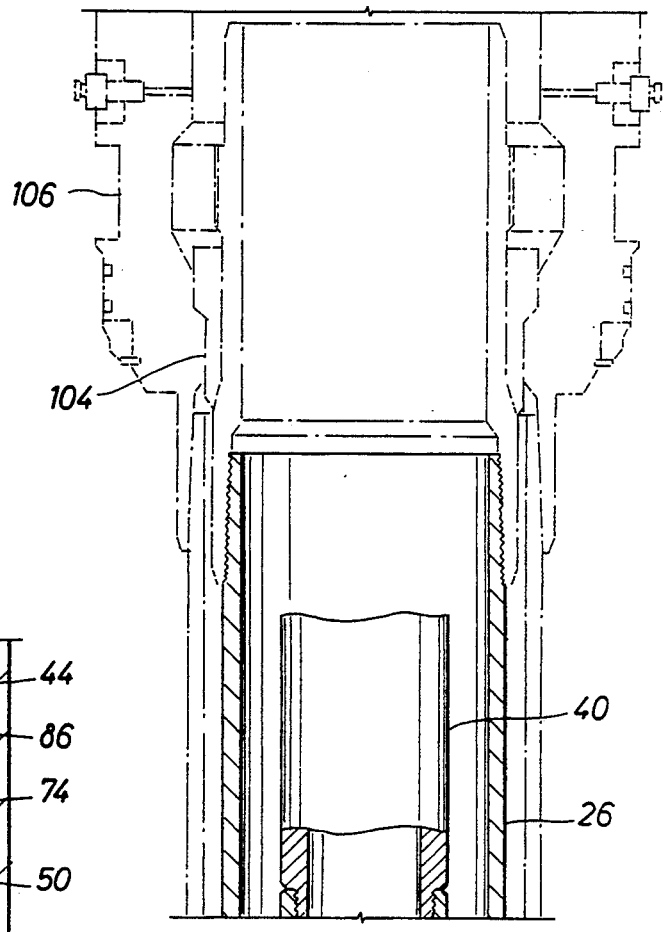
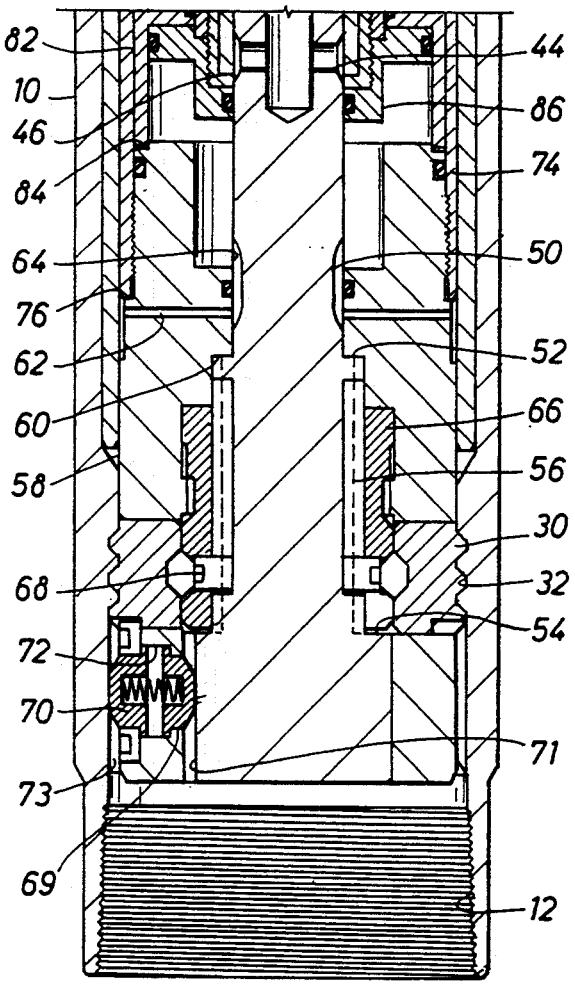
FIG. 1C

FIG. 6A
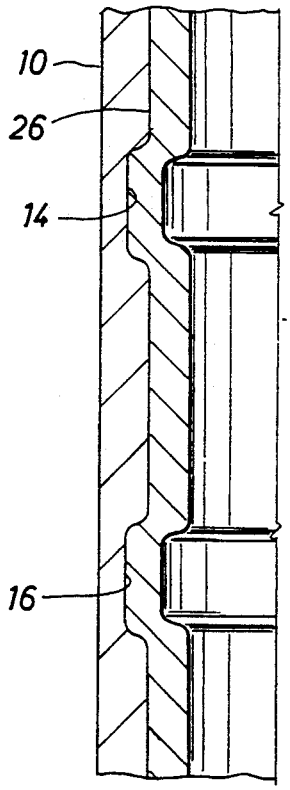
FIG. 6B
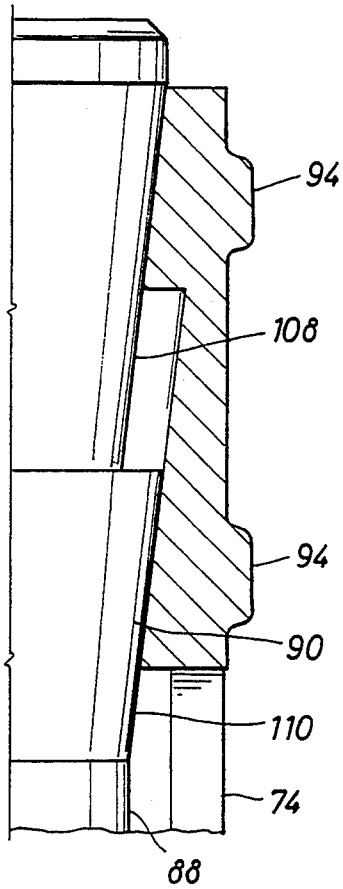
FIG. 7
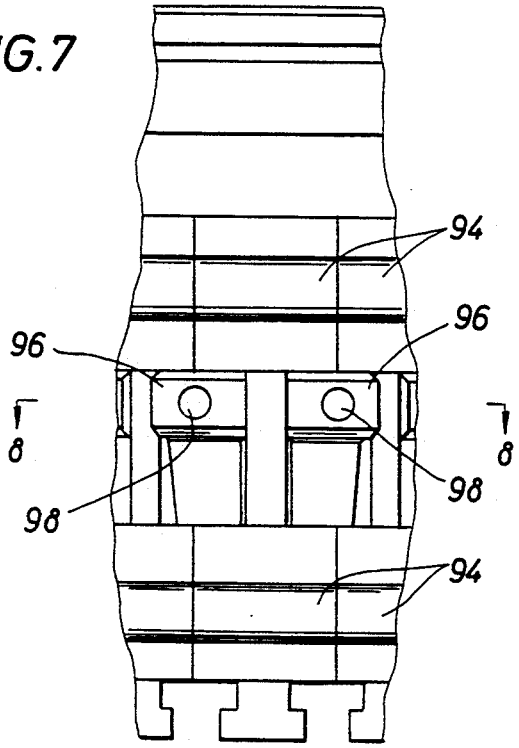
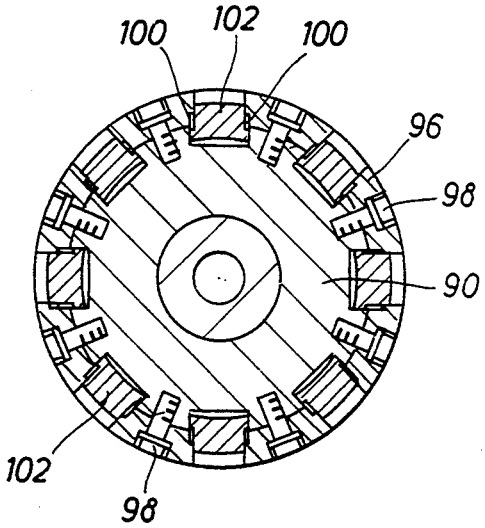
FIG. 8

TUBULAR CONNECTION, METHOD FOR MAKING SAME, AND TOOL THEREFOR

BACKGROUND

The present invention relates to a prestressed tubular connection for concentric members and a tool for making such connection within the well.

Prior to the present invention it has been known to mechanically or hydraulically deform a first tubular member into gripping and sealing engagement with a second tubular member which surrounds the portion of the first tubular member to be deformed. This is disclosed in the B. S. Minor et al. U.S. Pat. No. 2,134,311 wherein the top of a casing string is rolled into tight gripping and sealing engagement with a surrounding casing head. U.S. Pat. No. 4,580,426 discloses a sleeving apparatus in which a sleeve is rolled into engagement within a heat exchanger tube. U.S. Pat. No. 2,460,580 discloses the use of pressure to form a tubular member on opposite sides of a partition and U.S. Pat. No. 5,010,952 discloses hydraulically preforming a tubular member into a wellhead housing so that a compression preload is introduced into the joint. U.S. Pat. Nos. 4,902,048 and 4,902,049 discloses a connection between tubular members in which the deformation is made by tightening a binding band on a slotted outer member to deform the outer member into a groove in the inner member.

In oil and gas wells it has long been known to set combination anchors and packers around the exterior of a string to seal between the exterior of the string and the interior of the surface surrounding the string. These patents generally suggest a resilient sleeve which is compressed axially to cause it to seal against the interior surface surrounding the string and upper and lower slips which are set by wedges moving under the slips responsive to mechanical forces or pressure derived forces to cause the slips to move outward into gripping engagement with the interior surface. U.S. Pat. Nos. 2,189,703; 2,274,093; 2,467,801; 2,467,822; and 2,681,112 disclose examples of such anchor packer structures of the prior art.

A summary of the recent work in offshore drilling and making connections during such operations is disclosed in the Society of Petroleum Engineers Paper Nos. SPE 23054, 23057 and 23058 presented at Offshore Europe held in Aberdeen, Scotland, Sep. 3-6, 1991.

SUMMARY

The connection of the present invention which may be prestressed includes an inner tubular member and an outer tubular member wherein the outer tubular member includes a pair of grooves on its interior into which the inner tubular member is forged. The tool for making such connection includes means for supporting the inner tubular member within the outer tubular member, a plurality of multiple lobe forming elements and means for camming the multiple lobe forming element radially outward to deform the inner tubular member into the grooves on the interior of the outer tubular member while the inner tubular member is maintained in its prestressed condition.

An object of the present invention is to provide an improved tubular connection which may be formed within a well and which does not require a thick wall outer member into which the inner member is deformed.

Another object of the present invention is to provide an improved tubular connection which limits the plastic deformations of the tubular members.

Still another object of the present invention is to provide an improved tubular connection between a well tube and a well housing in which the stresses in the housing are kept below the elastic limit of the housing wall.

A further object of the present invention is to provide an improved method and apparatus for the forming of a tubular connection in a well in which the outer member into which an inner member is deformed is not subjected to stresses above its elastic limit.

A still further object is to provide an improved tubular joint in which a tubular member is deformed outwardly into grooves in an outer tubular member and the grooves are provided with means to ensure a gripping and sealing between the members after the forging is completed by storing and magnifying the strain energy.

Another object of the invention is to provide an improved tubular joint in which the outer tubular member includes grooves into which the inner tubular member is deformed and the grooves include load shoulders at their extremities to isolate the pre-loaded seal surfaces from additional tension or compression.

BRIEF DESCRIPTION OF THE DRAWINGS

These and other objects and advantages are hereinafter set forth and explained with reference to the drawings wherein:

FIGS. 1A, 1B and 1C are the upper, the intermediate and the lower sections of the apparatus of the present invention shown in longitudinal sectional views and showing the improved tool of the present invention with the inner tubular member and the outer housing supported thereon and being in running position. FIGS. 2A, 2B, 2C and 2D are similar views illustrating the landing of the surface hanger with the expansion joint having been stroked open and after the riser has been tied-back to the mudline hanger.

FIG. 6A is a partial detail sectional view of the forging as is completed and FIG. 6B is another partial detail sectional view of the multiple lobe cone and the forging elements in their set positions with respect to the cone.

FIG. 7 is a partial elevation view of the forging tool with the exterior profile being obscured.

FIG. 8 is a sectional view of the forging tool taken along line 8—8 in FIG. 7.

DESCRIPTION OF THE PREFERRED EMBODIMENTS

Figure 1A:
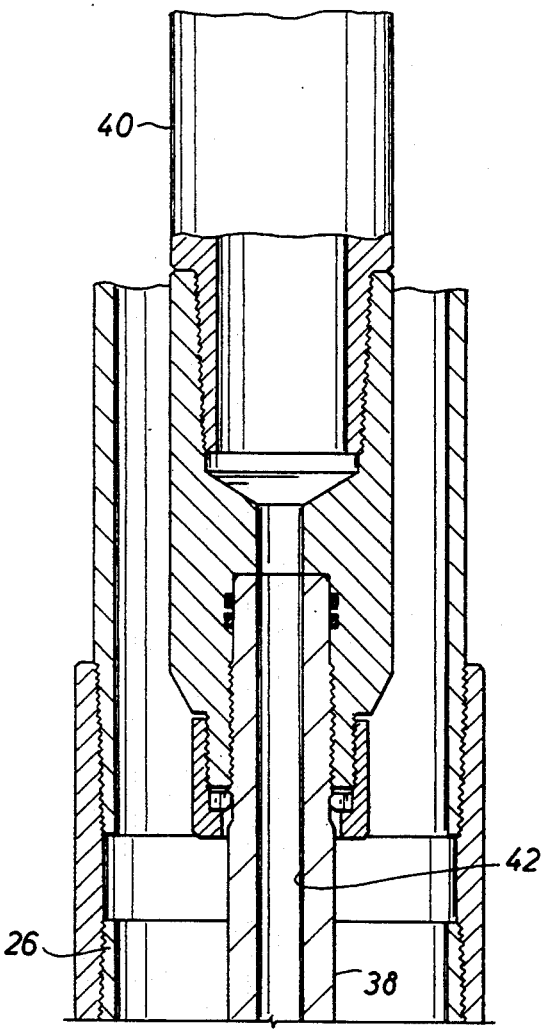

The improved structure of the present invention includes a casing housing 10 having a lower threaded portion 12 for the connection of a riser (not shown) therebelow. It should be noted that housing 10 is a relatively thin walled casing housing as compared to prior art casing housings into which a section of a tubular member is to be forged therein. Housing 10 includes an upper forging recess 14 and a lower forging recess 16. Upper recess 14 includes upper arcuate surface 18 which includes suitable serrations, intermediate cylindrical surface 19 and lower arcuate surface 20 which includes suitable serrations. Lower recess 16 includes upper arcuate surface 22 with suitable serrations, intermediate cylindrical surface 23 and lower arcuate surface 24, also having suitable serrations. The serrations in arcuate surfaces 18, 20, 22 and 24 ensure both gripping and sealing engagement between tubular member and housing 10 upon completion of the forging of tubular member as hereinafter described.

Figure 1B:
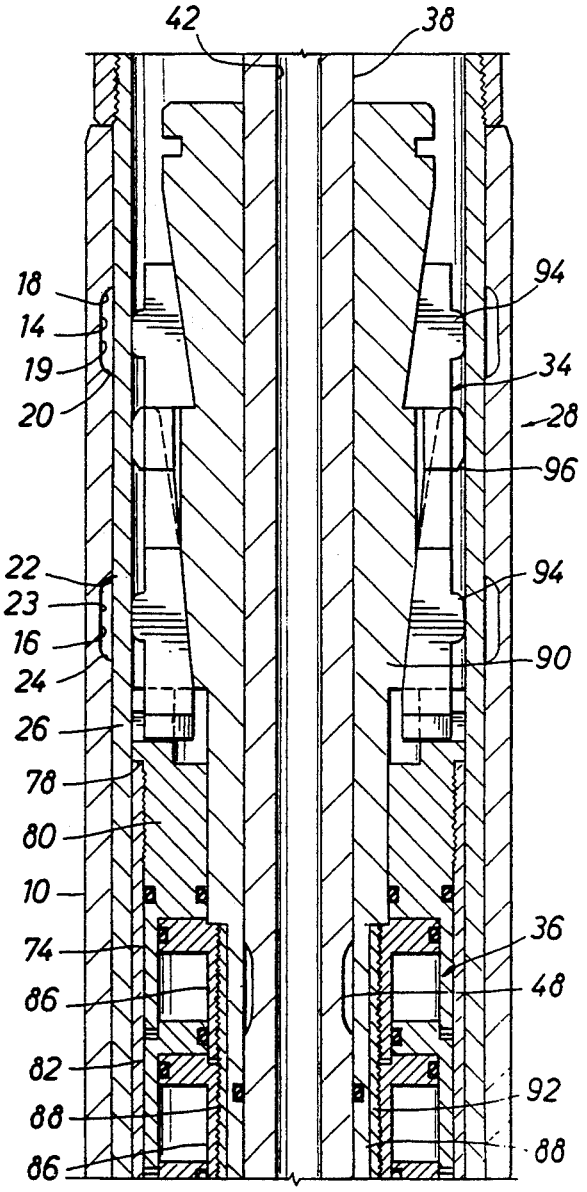

Expansion joint 26, the tubular member, is positioned immediately within housing 10 during running, as shown in the FIGS. 1A, 1B, and 1C. During running, running and forging tool 28 has housing 10 and expansion joint 26 supported thereon. Running tool 28 is secured within the lower portion of housing 10 by the engagement of latching segments 30 within internal grooves 32 on the interior of housing 10. Tool 28 also includes forging assembly 34 and pressure responsive means 36 supported on central tubular member 38 which is lowered on string 40. Central tubular member 38 includes bore 42 which extends downwardly therein and terminates a short distance below ports 44 which extend radially through member 38 to annular groove 46 on its exterior. Upper groove 48 extends around the exterior of member 38 above groove 46 and lower groove 50 extends around the exterior of member 38 below groove 46. The exterior of member 38 below lower groove 50 includes first upwardly facing shoulder 52 and second upwardly facing shoulder 54 below shoulder 52. Slots 56 which are diametrically opposed to each other are positioned on the exterior of member 38 extending from first shoulder 52 to second shoulder 54. Mandrel 58 is positioned in surrounding relationship to the lower portion of member 38 and in running position is supported on upper shoulder 52 with its internal downwardly facing shoulder 60 resting thereon. Ports 62 extend radially through mandrel 58 immediately above shoulder 60 and provide communication from its inner bore 64 to its exterior. Cam ring 66 is slidably positioned around the portion of member 38 between shoulders 52 and 54 and pins 68 extend through ring 66 into slots 56. Cam ring 66 includes external projections and recesses which coact with the internal projections and recesses on latching segments 30 for the movement of latching segments 30 into engagement in grooves 32 and allowing their release from such position. Cam ring 66 is also threaded into the interior of mandrel 58 so that relative rotation causes movement of cam ring 66 relative to latching segments 30. In the position shown in FIG. 1C, the projections of cam ring 66 and segments 30 match so that segments are held in their outer position in latching engagement within internal groove 32. This engagement secures tool 28 within housing 10. Spring loaded inner and outer keys 69 and 70 are positioned in windows 72 below segments 30 and are urged both radially outward into groove 71 and inward into groove 73 to allow axial movement of central tubular member 38 within mandrel 58 and prevent relative rotation therebetween when positioned as shown in FIG. 1C. Housing 10 has an increase in internal diameter above groove 32 and expansion joint 26 is positioned above such increase in diameter within housing 10 and in surrounding relationship to mandrel 58. Sleeve 74 is supported between upwardly facing shoulder 76 on the exterior of mandrel 58 and downwardly facing shoulder 78 of upper cylinder member 80 of pressure responsive means 36.

Pressure responsive means 36 includes a plurality of cylinder elements 82 positioned below upper cylinder member 80 and shoulder 84 at the upper outer portion of mandrel 58 and a plurality of piston elements 86 which surround and are in threaded engagement with depending tubular portion 88 of multiple lobe cone 90. The exterior of tubular portion 88 is provided with a pressure transmitting slot 92. As is hereinafter described, pressure delivered through bore 42 of central tubular member 38 passes through ports 44 and slot 92. The pressure is exerted between piston elements 86 and cylinder elements 82 to cause relative movement between forging segments 94 and cone 90.

As best seen in FIG. 8, forging tool assembly 34 includes forging elements or segments 94 which are mounted on cone 92 by blocks 96 through which suitable fasteners 98 pass to cause blocks 96 to engage shoulders 100 on the thin central portion 102 of forging elements 94 to maintain forging elements 94 in their desired position on cone 92 during running, forging and retrieving operations. The upper end of upper cylinder member 80 is interengaged with the lower end of forging segments 94 so that axial movement of cone 90 does not cause forging elements 94 to move axially. The outer surfaces of forging elements 94 are contoured to have the shape which coacts to forge expansion joint 26 into recesses 14 and 16 of tubular housing 10 without causing strain in housing 10 to exceed its elastic limit. This allows the use of a relative thin housing as compared to prior art housings used to receive cold forging of a tubular member therein without danger of deforming the housing 10.

Figure 2B:
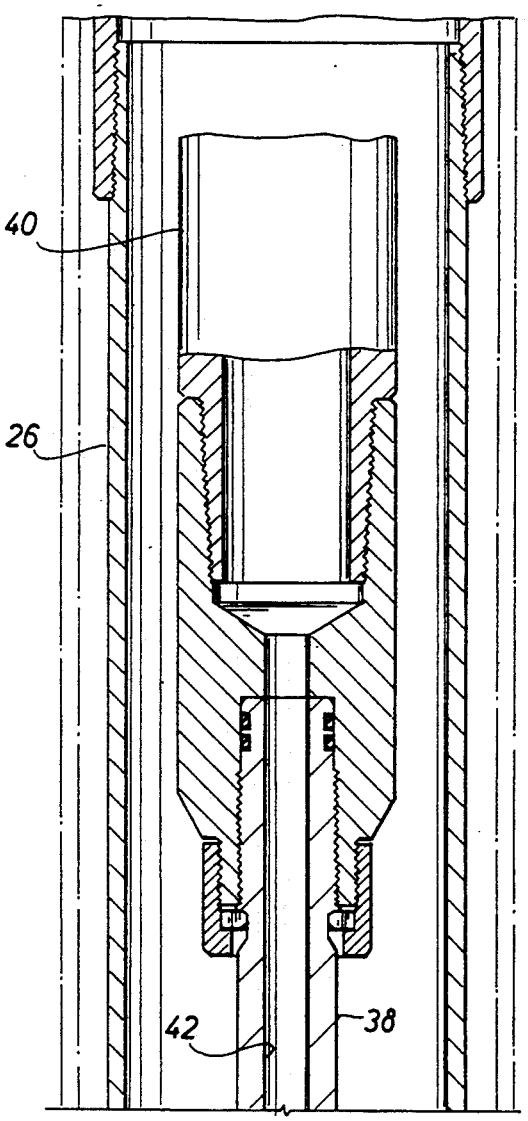
Figure 2C:
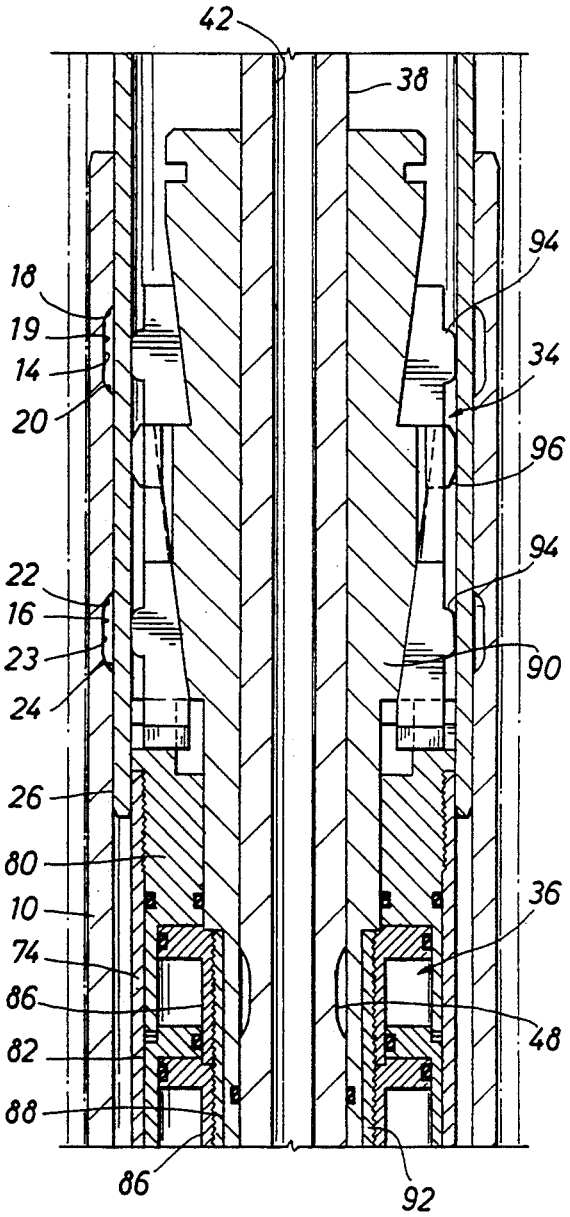
Figure 2D:
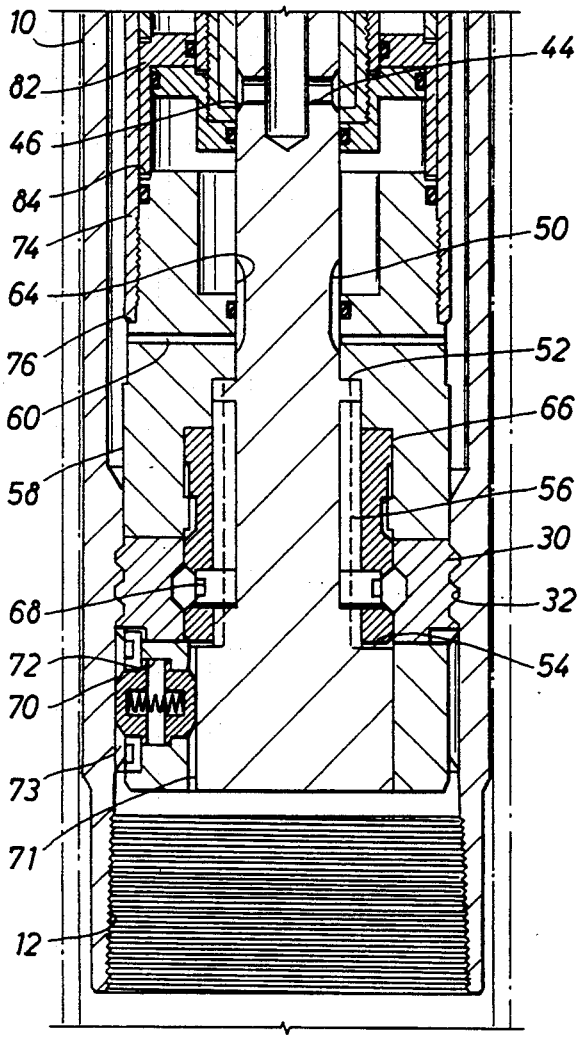

When tool 28 and housing 10 have been run into the subsea well to the position illustrated in FIG. 2 series of the drawings, hanger 104 which is secured to housing 10 above tool 28 is landed in surface wellhead 106. Further lowering of tool 28 causes expansion joint 26 to be stroked open and then the riser is tied-back to the mudline hanger (not shown). This position is clearly illustrated in FIGS. 2A, 2B, 2C and 2D.

Figure 3A:
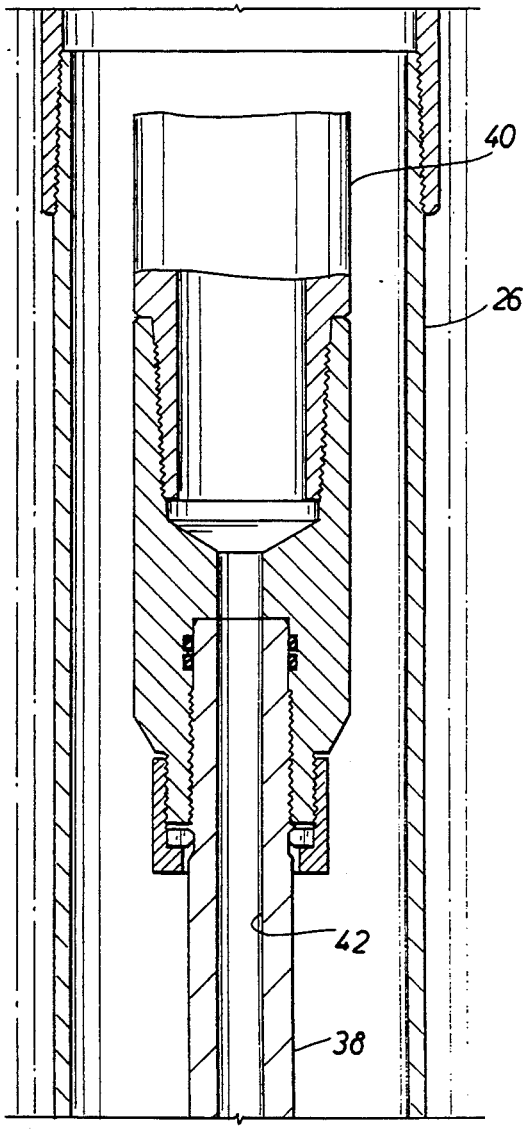
FIGS. 3A, 3B, and 3C are other similar views illustrating the forging of the joint with the riser under tension.
Figure 3B:
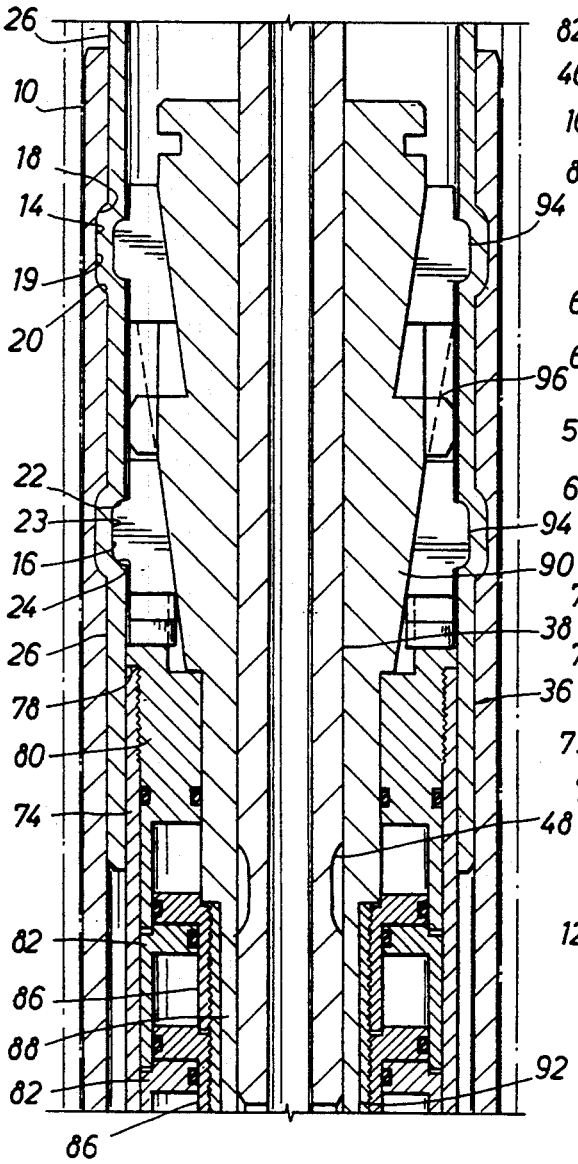
Figure 3C:
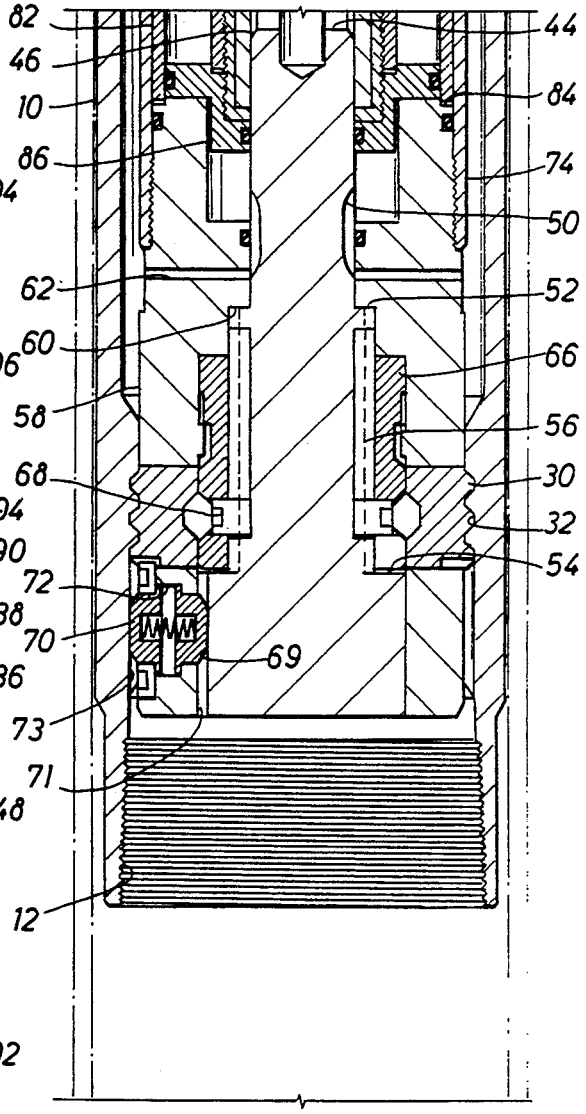

At this point a tension is established by exerting an upward pull on running string 40. When the desired tension has been established, pressure is delivered through running string 40 through bore 42, radial ports 44 and slot 92 into the spaces between each pair of cylinder elements 82 and piston elements 86. Upper cylinder member 80, being threaded within sleeve 74 and mandrel 58 also being threaded within sleeve 74 secures piston elements 82 against movement while piston elements 86 are free to respond to movement and their connection to depending tubular portion 88 of multiple lobe cone 90 causes cone 90 to move downwardly within forging segments 94. Cone 90, as shown, includes upper wedging surface 108 which engages the inner surfaces 110 of upper forging segments 94 and lower wedging surface 110 engages lower inner wedging surfaces 112 of lower forging segments 94 and forging segments 94 are forced radially outward so that expansion joint 26 is cold forged into recesses 14 and 16. With this configuration and apparatus, the connection is completed between expansion joint 26 and housing 10 which does not require housing 10 to be as thick and strong as the prior art devices since the process while completing the connection with the tension maintained in housing 10 and providing a gripping and sealing engagement between expansion joint 26 and housing 10. This position is shown in FIGS. 3A, 3B AND 3C.

Figure 4A:
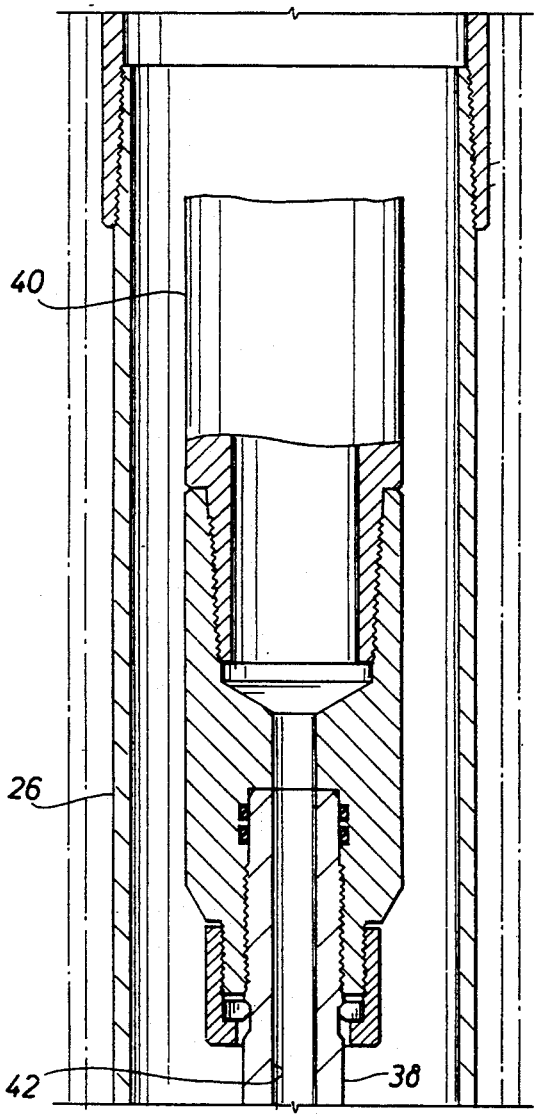
FIGS. 4A, 4B and 4C are other similar views with the running tool released.
Figure 4B:
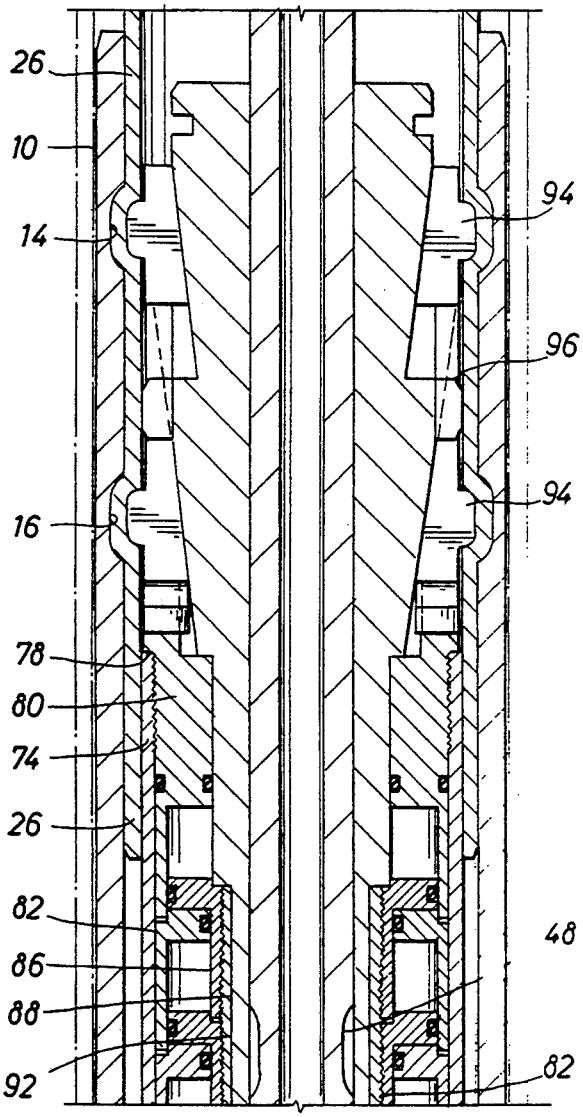
Figure 4C:
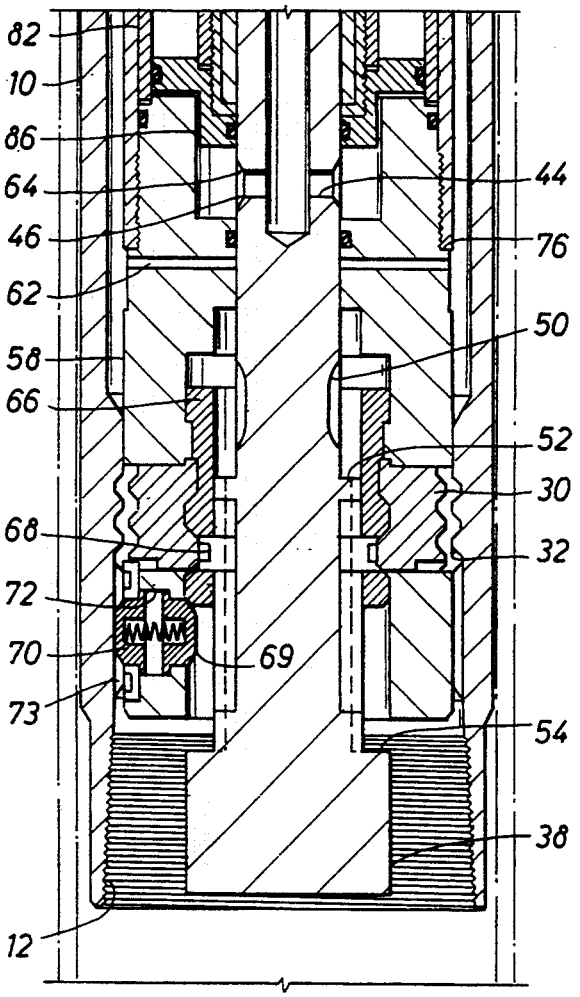

The release of latching segments 30 from groove 32 is accomplished by lowering running string 40 and rotating so that cam ring 66 is moved upward relative to latching segments 30. (FIGS. 4A, 4B and 4C). The rotation is possible by the lowering of the lower end of central tubular member 38 so that slot 71 is below inner key 69 so that cam ring 66 rotates with member 38 while mandrel 58 to which cam ring 66 is threaded is held against rotation by the engagement of key 70 in slot 73. The downward movement of member 38 brings ports 44 into alignment with the space between the upper interior of mandrel 58 and lower piston member 86 as shown in FIG. 4C.

Figure 5A:
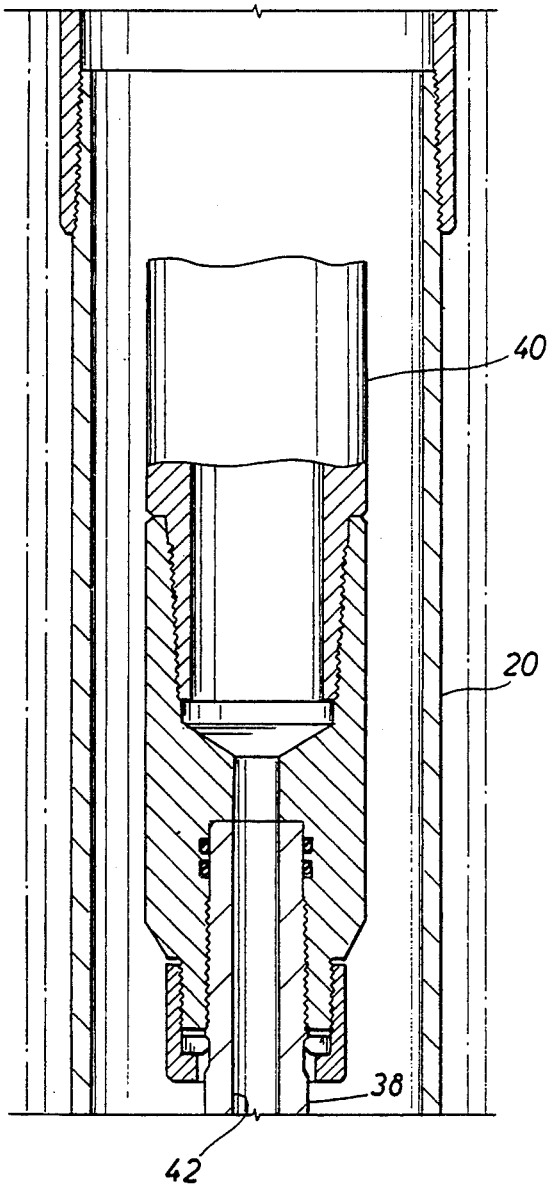
FIGS. 5A, 5B and 5C are other similar views with the forging elements retracted.
Figure 5B:
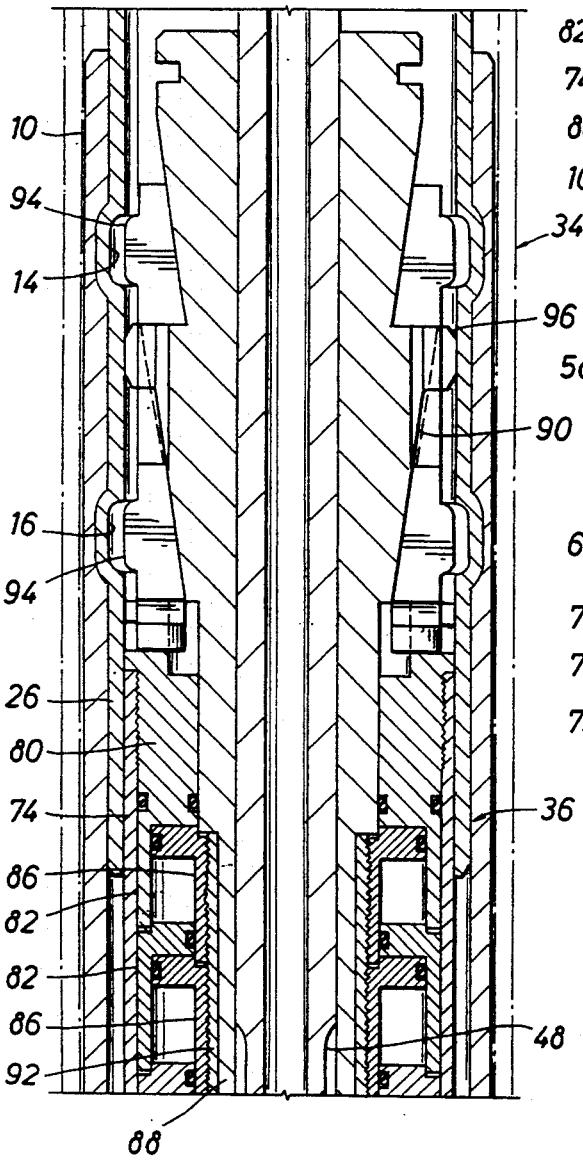
Figure 5C:
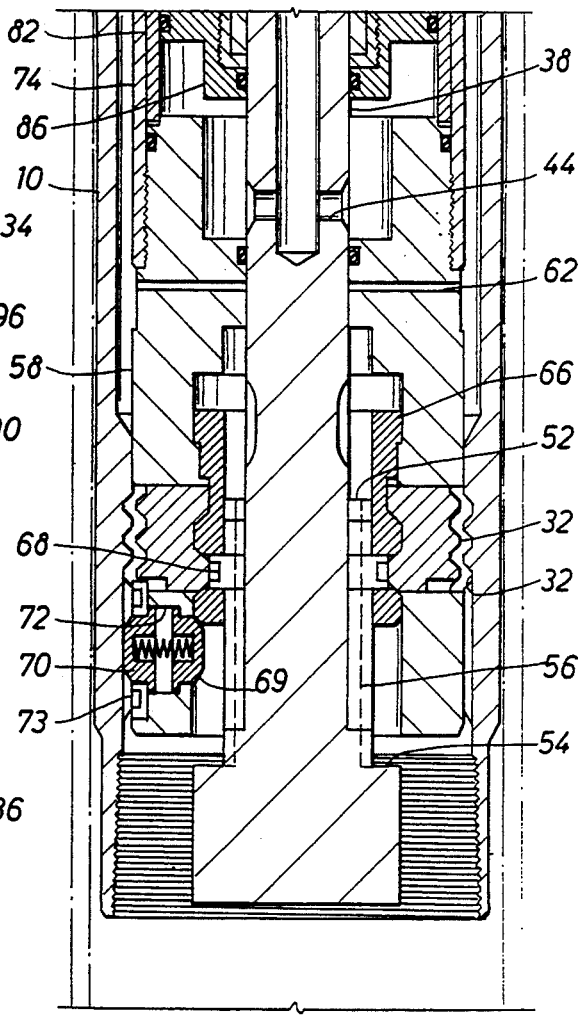

With member 38 in this position, pressure is delivered through member 38 into the space between mandrel 58 and lower piston element 86. This pressure is also delivered along the interior of sleeve 74 to the space between each of piston elements 86 and their relative cylinder element 82 so that piston element 86 are moved to their original position which causes an upward movement of cone 90 and permits the retraction of forging segments 94 as string 40 is raised and retrieved. The released position of forging segments 86 is illustrated in FIGS. 5A, 5B and 5C. Pressure, previously applied for setting forging segments 86 is vented from within cylinder element 82 through groove 48 and along the exterior of member 38 to be released above cone 90.

FIG. 6A illustrates in its left-hand portion the completed forged joint and FIG. 6B in the right-hand portion the set position of forging segments 94 on cone 90.

What is claimed is:

1. The method of making a connection between two tubular members, one of which is a tubular housing having both upper and lower spaced apart recesses and the other of which is a section of a tubular member including the steps of positioning said section of a tubular member within said tubular housing, positioning said mechanical forging elements within said section at positions immediately within said tubular housing recesses, said mechanical forging elements having an external shape to deform said section into mechanical gripping and sealing engagement within said recesses without overstressing the housing, releasably supporting said tubular member section within said tubular housing with said forging elements at their desired positions with respect to said housing recesses, and wedging said mechanical forging elements radially outward to deform said section into said tubular housing recesses.

2. The method according to claim 1 wherein said section includes a hanger adapted to seat on a surface landing seat and wherein said releasably supporting step is provided by landing the hanger in the surface landing seat to position said section in its desired position within the tubular housing.

3. A method of making a connection between two tubular members within a well, one of which is a tubular housing having both upper and lower spaced apart recesses and a landing seat, and the other of which is a hanger adapted to seat on a landing seat including the steps of running said hanger within said tubular housing on a running string and landing the hanger on the landing seat to position said hanger in its desired position within said tubular housing, the running of said hanger also positioning mechanical forging elements within said hanger at positions immediately within said tubular housing recesses, said mechanical forging elements having an external shape to deform said hanger into mechanical gripping and sealing engagement within said recesses without overstressing the housing, and wedging said mechanical forging elements radially outward to deform said hanger into said tubular housing recesses.

4. The method according to claim 3 including the step of maintaining upward tension on the lower end of the housing during the wedging step.

5. The method according to claim 3 wherein said tubular housing recesses include arcuate surfaces which store and magnify the strain energy of the wedging step and sealing surfaces to ensure metal-to-metal sealing between the hanger and the tubular housing.

6. The method according to claim 5 including serrations on said arcuate surfaces of said recesses to assist in tight gripping engagement between said tubular housing and said hanger.

* * * * *